US006633257B2

(12) United States Patent
Ito

(10) Patent No.: US 6,633,257 B2
(45) Date of Patent: Oct. 14, 2003

(54) ANTENNA ELEMENT, ADAPTIVE ANTENNA APPARATUS, AND RADIO COMMUNICATION APPARATUS

(75) Inventor: Hiroki Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/877,310

(22) Filed: Jun. 8, 2001

(65) Prior Publication Data

US 2001/0052874 A1 Dec. 20, 2001

(30) Foreign Application Priority Data

Jun. 9, 2000 (JP) ..... P2000-174309

(51) Int. Cl.[7] ..... H01Q 3/22
(52) U.S. Cl. ..... 342/368; 343/700 MS
(58) Field of Search ..... 342/368–377; 343/700 MS

(56) References Cited

U.S. PATENT DOCUMENTS

| | | | | | |
|---|---|---|---|---|---|
| 3,710,281 | A | * | 1/1973 | Thomas | 342/373 |
| 5,003,318 | A | | 3/1991 | Berneking et al. | |
| 5,151,706 | A | * | 9/1992 | Roederer et al. | 342/373 |
| 5,497,168 | A | | 3/1996 | Thomas et al. | |
| 5,844,523 | A | * | 12/1998 | Brennan et al. | 343/700 MS |
| 6,097,271 | A | * | 8/2000 | Kozakoff | 343/700 MS |
| 6,292,143 | B1 | * | 9/2001 | Romanofsky | 343/700 MS |
| 6,369,759 | B1 | * | 4/2002 | Epp et al. | 343/700 MS |
| 6,392,610 | B1 | * | 5/2002 | Braun et al. | 343/700 MS |
| 6,421,025 | B1 | * | 7/2002 | Drize et al. | 342/371 |
| 6,433,744 | B1 | * | 8/2002 | Hershey et al. | 343/700 MS |
| 6,448,930 | B1 | * | 9/2002 | Judd | 343/700 MS |
| 6,552,696 | B1 | * | 4/2003 | Sievenpiper et al. | 343/700 MS |
| 2002/0011954 | A1 | * | 1/2002 | Judd et al. | 343/700 MS |

FOREIGN PATENT DOCUMENTS

| | | |
|---|---|---|
| EP | 0817310 | 1/1998 |
| WO | 9309613 | 5/1993 |
| WO | 9525409 | 9/1995 |

OTHER PUBLICATIONS

Phased Array Antenna Handbook, R.J. Mailloux, Artech House, Inc., pp. 290–291, 313–314, 1994.*

TX RX Systems Inc. Brochure, Base Station Antenna, http://www.txrx.com/pdf/Antenna.pdf, printed Apr. 29, 2003.*

Conformal microstrip antennas and microstrip phased arrays, R. Munson, IEEE Transactions on Antennas and Propagation, pp. 74–78, Jan. 1974.*

Abo El Ata A M et al: "Dielectric and magnetic permeability behavior of BaCo2–xNixFe16027 W–type hexaferriteis" Jouranl of Magnetism and Magnetic Materials, Elsevier Science Publishers, Amsterdam, NL, vol. 204, No. 1–2, Sep. 1999 (Sep. 1999), pp. 36–44, XP004180288 ISSN: 0304–8853 *the whole document*.

Abo El Ata A M et al: "Room temperature electric and dielectric properties of polycrystalline BaCo/sub 2x/Zn/sub x/Fe/sub 12–2x/0/sub 19/" Journal of Materials Science Letters, Mar. 1, 1998, Chapman & Hall, UK, vol. 17, No. 5, pp. 409–413, XP009007841 ISSN: 0261–8028 *the whole document*.

* cited by examiner

*Primary Examiner*—Thomas H. Tarcza
*Assistant Examiner*—F H Mull
(74) *Attorney, Agent, or Firm*—Jay H. Maioli

(57) ABSTRACT

An antenna element includes a substrate formed of a dielectric material having a specific inductive capacity exhibiting frequency distributing properties, a grounding conductor formed on one surface of the substrate, a plurality of radiating conductors formed on the other surface of the substrate, and a plurality of feeder lines provided for passing through the substrate for connecting the grounding conductor to the radiating conductors. This antenna element is able to achieve equivalent gain for plural frequencies.

9 Claims, 6 Drawing Sheets

(PRIOR ART)

ANTENNA ELEMENT, ADAPTIVE ANTENNA APPARATUS, AND RADIO COMMUNICATION APPARATUS

BACKGROUND OF THE INVENTION

1. Field of the Invention

This invention relates to an antenna element for realizing equivalent gain for plural frequencies and to a radio apparatus applicable to plural radio communication systems having different frequency domains by having this antenna element mounted thereon.

2. Description of Related Art

In a radio communication system, such as a portable telephone system, which has come into surprisingly widespread use, not only call services but also transmission services for transmission of text information, such as E-mail. In the portable telephone system, downloading services for received melodies or character distributing services have met high acclamation. In the portable telephone system, a wide variety of measures are being taken to transmit the various forms of the information more speedily and at a higher quality. In near future, high quality moving picture information will also be transmitted in real-time.

As a new system to cope with high transmission speed in inland use, services conforming to IMT-2000 (International Mobile Telecommunication-2000) are scheduled to be started in the field of the portable telephone system. In this system, services can be furnished for the time being at a rate of 384 kbits/sec, against 64 kbits/sec of the pre-existing system, as a result of allocation of a new frequency band (2 GHz band). In the portable telephone system, a need exists for an equipment that enables various information signals to be received in this new frequency band.

In each radio communication system, the frequency band is prescribed, such that the limited frequency range needs to be exploited efficiently. The radio communication system needs to be designed so that an equipment exploiting the system will receive only the desired electrical waves while not receiving other electrical waves which prove to be interference, in order to permit the system to be exploited efficiently. In the radio communication system, an adaptive array antenna 100, shown in FIGS. 1 to 3, is mounted on the equipment exploiting the system.

Referring to FIG. 1, the adaptive array antenna 100 includes plural antenna element 101, plural reception circuit units 102 for demodulating high harmonics received by the respective antenna element 101, and a parallel signal processing circuit unit 103 for optimizing the signals optimized by the reception circuit units 102. The adaptive array antenna 100 is adapted for simultaneously receiving high frequency signals oncoming from different directions by the antenna element 101 and for interrupting high frequency interference signals.

The respective reception circuit units 102 down-convert the high frequency signals received by the respective antenna element 101 to demodulate the received signals to bit signals. The parallel signal processing circuit unit 103 optimally synthesizes bit signals supplied from the reception circuit units 102. The adaptive array antenna 100 synthesizes bit signals in the manner of cancelling the information other than the information needed in the parallel signal processing circuit unit 103, and the noise, to operate as if the unit 100 is oriented in alignment with the direction of electrical waves for which antenna directivity is required, while being null with respect to the direction of oncoming of interference electrical waves.

The adaptive array antenna 100 provides plural outputs from the parallel signal processing circuit unit 103, so that, if there are two or more information that are required, the respective information will be output separately. That is, the adaptive array antenna 100 has characteristics such that it operates with plural directivities in meeting with the number of the required information. The adaptive array antenna 100 features enabling reception of plural information employing the same frequency band possibly present in the same space without crosstalk to achieve effective utilization of the frequency band.

The antenna element 101 includes, as shown in FIGS. 2 and 3, a rectangular dielectric substrate 104 of e.g., Teflon (trade name of a product manufactured by DuPont de Nemur), a grounding conductor 105 provided on a first major surface 104*a* of the dielectric substrate 104, plural radiating conductors 106 bonded to a second major surface 104*b* of the dielectric substrate 104 and a feeder line 107 interconnecting the grounding conductor 105 and the radiating conductors 106. The dielectric substrate 104 has a specific inductive capacity $\epsilon 0$ and includes plural feeder guide holes 108 passing through the first major surface 104*a* and the second major surface 104*b*, as shown in FIG. 3.

The grounding conductor 105 is a metallic plate of, for example, copper or brass, bonded to the first major surface 104*a* of the dielectric substrate 104. On the bottom surface of the grounding conductor 105 are arranged the reception circuit units 102. The radiating conductors 106 are bonded to the second major surface 104*b* of the dielectric substrate 104 kept parallel to the grounding conductor 105. The radiating conductors 106 are formed e.g., by chips of metal, such as copper or brass, each being of a square shape with each side being L in length. The length L of each side of the radiating conductor 106 is $\lambda/2$, where $\lambda$ is the wavelength of the wave transmitted/received. The length L of the radiating conductor 106 is also set by $$2L=c/(f0\times\sqrt{\epsilon 0})$$

where f0 is the transmission frequency and c is the light velocity.

The feeder line 107 is a coaxial cable passed through the feeder guide hole 108 to interconnect the radiating conductors 106 and the associated reception circuit units 102. Although not shown in detail, the feeder line 107 has its shell conductor and a core line connected to the grounding conductor 105 and to the radiating conductors 106, respectively.

In the above-mentioned adapter array antenna 100, high frequency signals 109 (109*a*, 109*b*, 109*c*) of the same frequency band, transmitted from different directions, are received by respective antenna element 101, as shown in FIG. 3. In the adapter array antenna 100, the high frequency signals 109 are down-converted in the respective reception circuit units 102 associated with the antenna element 101 for demodulation to bit signals. As shown in FIG. 1, the adapter array antenna 100 synthesizes the bit signals supplied from the respective reception circuit units 102 in the parallel signal processing circuit unit 103 such as to cancel the information other than the information needed in the parallel signal processing circuit unit 103 and noise to output the resulting signal.

In the radio communication system, plural systems employing different frequency bands have come to be furnished, as described above, such that equipment to be used in the system are required to cope with these systems. If the equipment is to be usable in common by the respective radio communication systems, plural antennas adapted to the respective systems are needed, thus being increased in size and cost.

consideration that the portable telephone system has become surprisingly widespread on account of the small size and weight and inexpensiveness of the equipment, it is not possible to permit the portable telephone set to be bulky in size and costly with the introduction of new portable telephone system as described above. So, the new portable telephone system has an inconvenience that a portable telephone set furnished is not compatible with the conventional portable telephone set.

The conventional adaptive array antenna controls the directivity in the same frequency band to enable effective frequency utilization. If this adaptive array antenna is to be applied to plural systems having different frequency bands, plural antenna adapted to the specifications of the respective systems need to be used, as in other types of the antenna.

SUMMARY OF THE INVENTION

It is therefore an object of the present invention to provide an antenna and a radio apparatus which, in view of the above-described characteristics of the adaptive array antenna, the necessary information can be positively received in plural frequency bands to achieve effective frequency utilization.

In one aspect, the present invention provides a antenna element including a substrate formed of a dielectric material having a specific inductive capacity exhibiting frequency distributing properties, a grounding conductor formed on one surface of the substrate, a plurality of radiating conductors formed on the other surface of the substrate and a plurality of feeder lines provided for passing through the substrate for connecting the grounding conductor to the radiating conductors.

With the antenna element of the present invention, in which the substrate is formed of a dielectric material having frequency distribution characteristics, an equivalent gain may be achieved for plural frequencies.

In another aspect, the present invention provides an adaptive antenna apparatus including a substrate formed of a dielectric material having a specific inductive capacity exhibiting frequency distributing properties, a grounding conductor formed on one surface of the substrate, a plurality of radiating conductors formed on the other surface of the substrate, a plurality of feeder lines provided for passing through the substrate for connecting the grounding conductor to the radiating conductors, a frequency distributing circuit fed with a reception signal of a plurality of frequency bands from the radiating conductors over the feeder line for outputting signals of the frequency bands in the reception signal in separate frequency bands, a plurality of demodulation circuits for demodulating the signals of the respective frequency bands from the frequency distributing circuit, and a signal synthesis circuit for synthesizing demodulated signals from the demodulating circuits according to the separate frequency bands.

With the adaptive antenna apparatus of the present invention, plural information transmitted from plural systems with different frequency bands can be received without crosstalk by a sole antenna device so that it is possible to reduce the size of the device.

DESCRIPTION OF THE PREFERRED EMBODIMENTS

Figure 1:
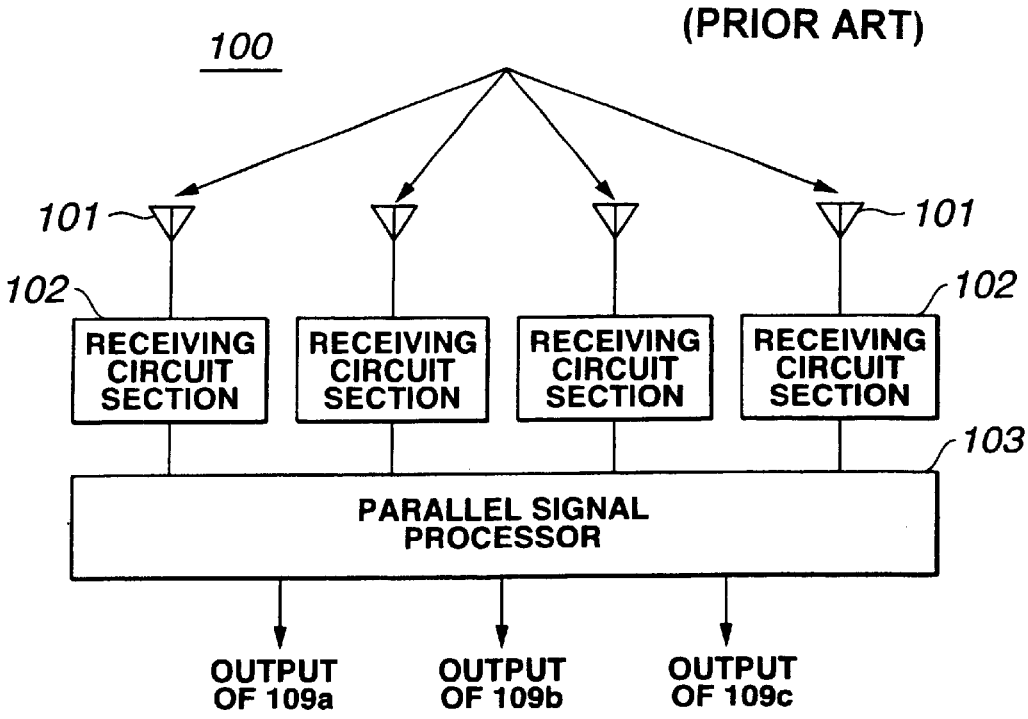
FIG. 1 is a schematic view showing a conventional adaptive array antenna.
Figure 2:
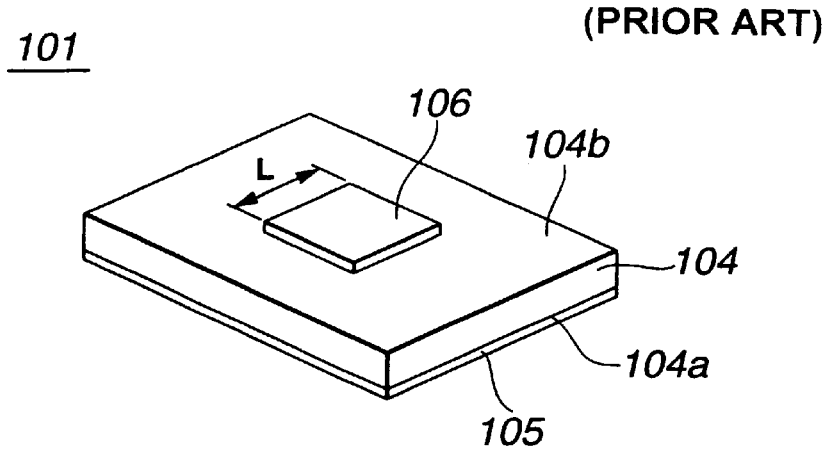
FIG. 2 is a perspective view showing a flat antenna used as an antenna element in the adaptive array antenna shown in FIG. 1
Figure 3:
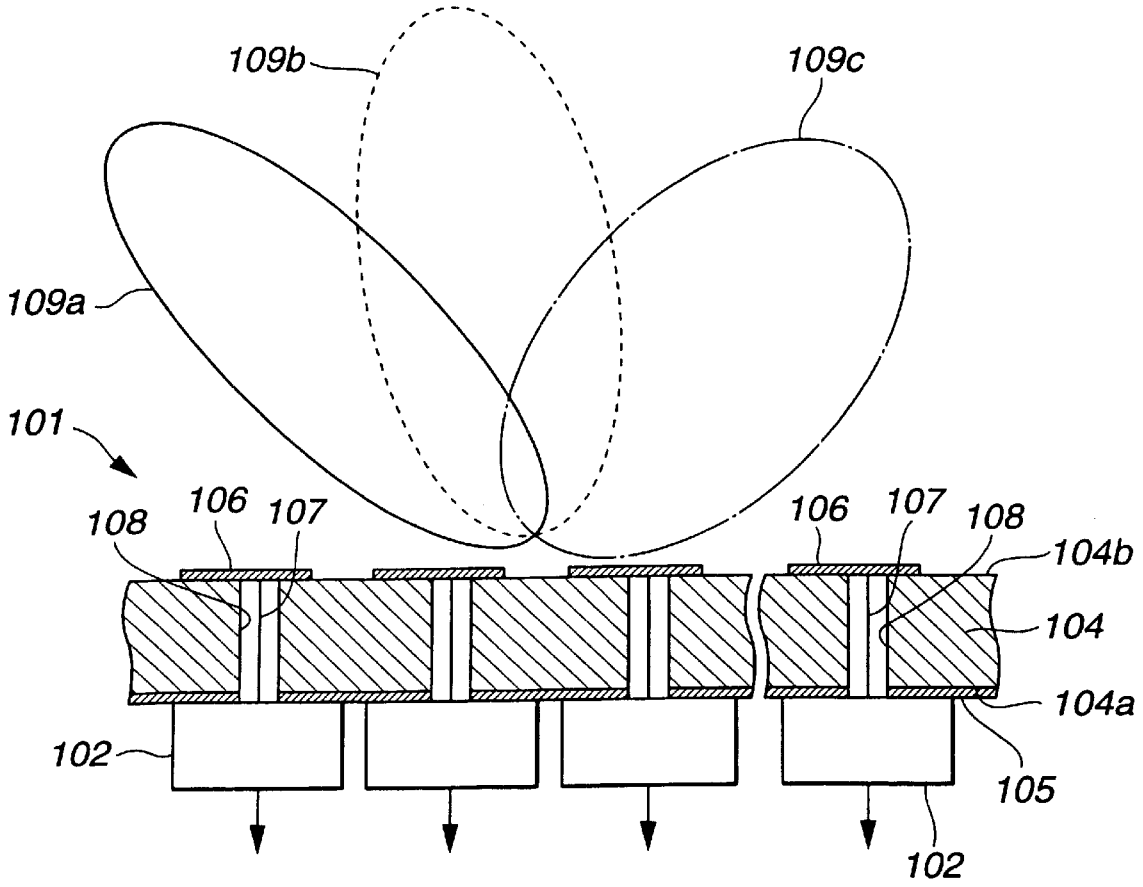
FIG. 3 is a schematic view showing a structure of a reception unit of the adaptive array antenna shown in FIG. 1.
Figure 4:
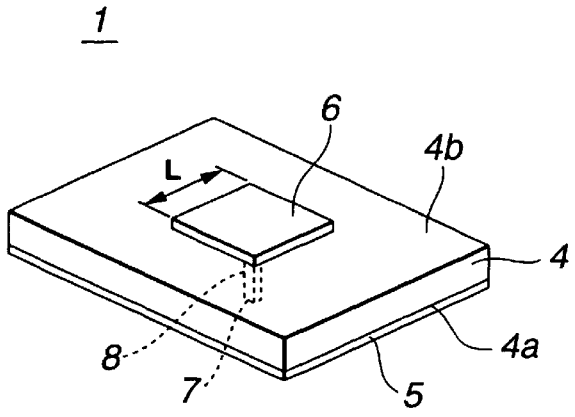
FIG. 4 is a perspective view showing a flat antenna embodying the present invention.
Figure 6:
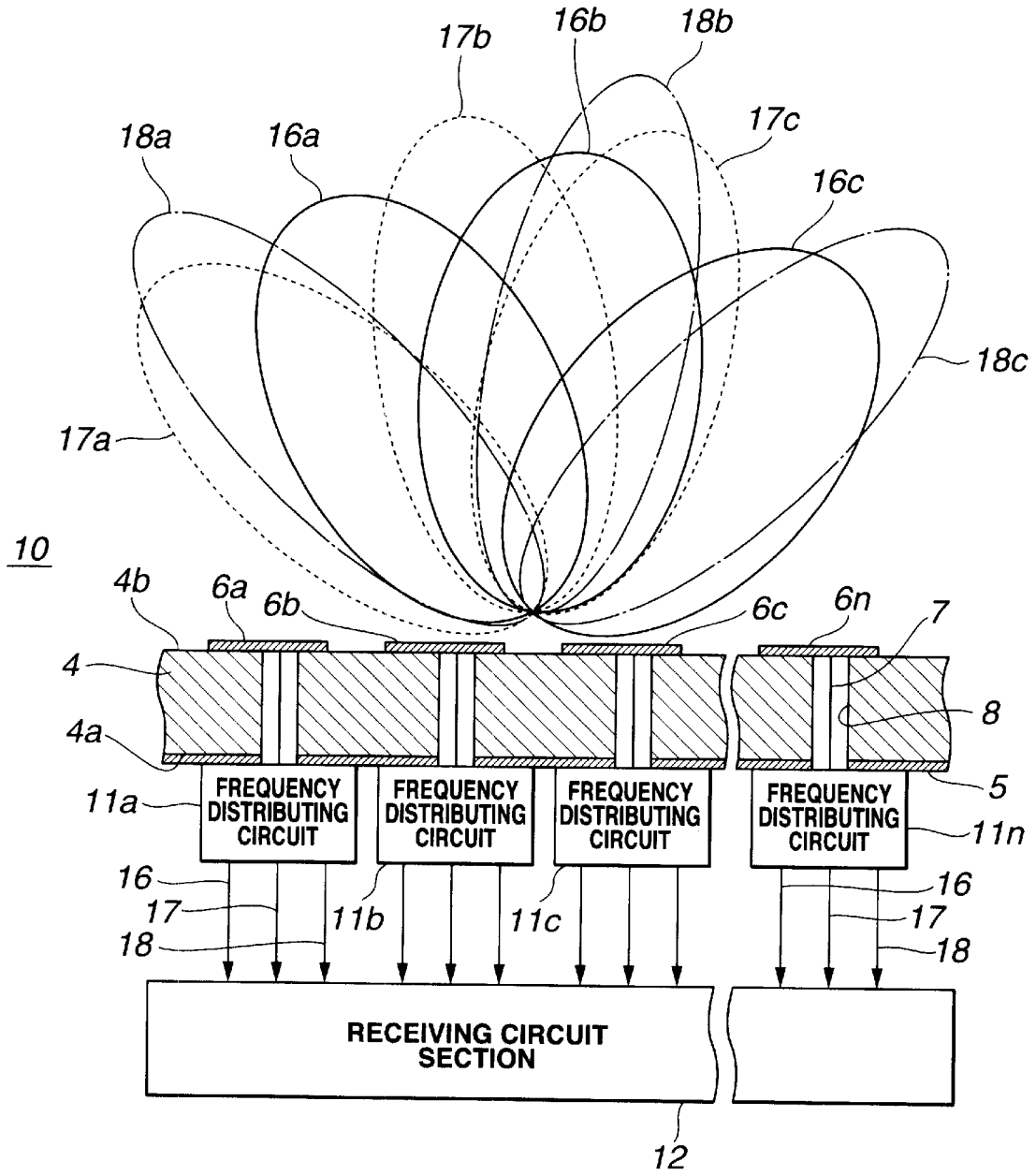
FIG. 6 is a schematic view showing a structure of a reception unit of an adaptive array antenna employing the flat antenna as an antenna element.
Figure 7:
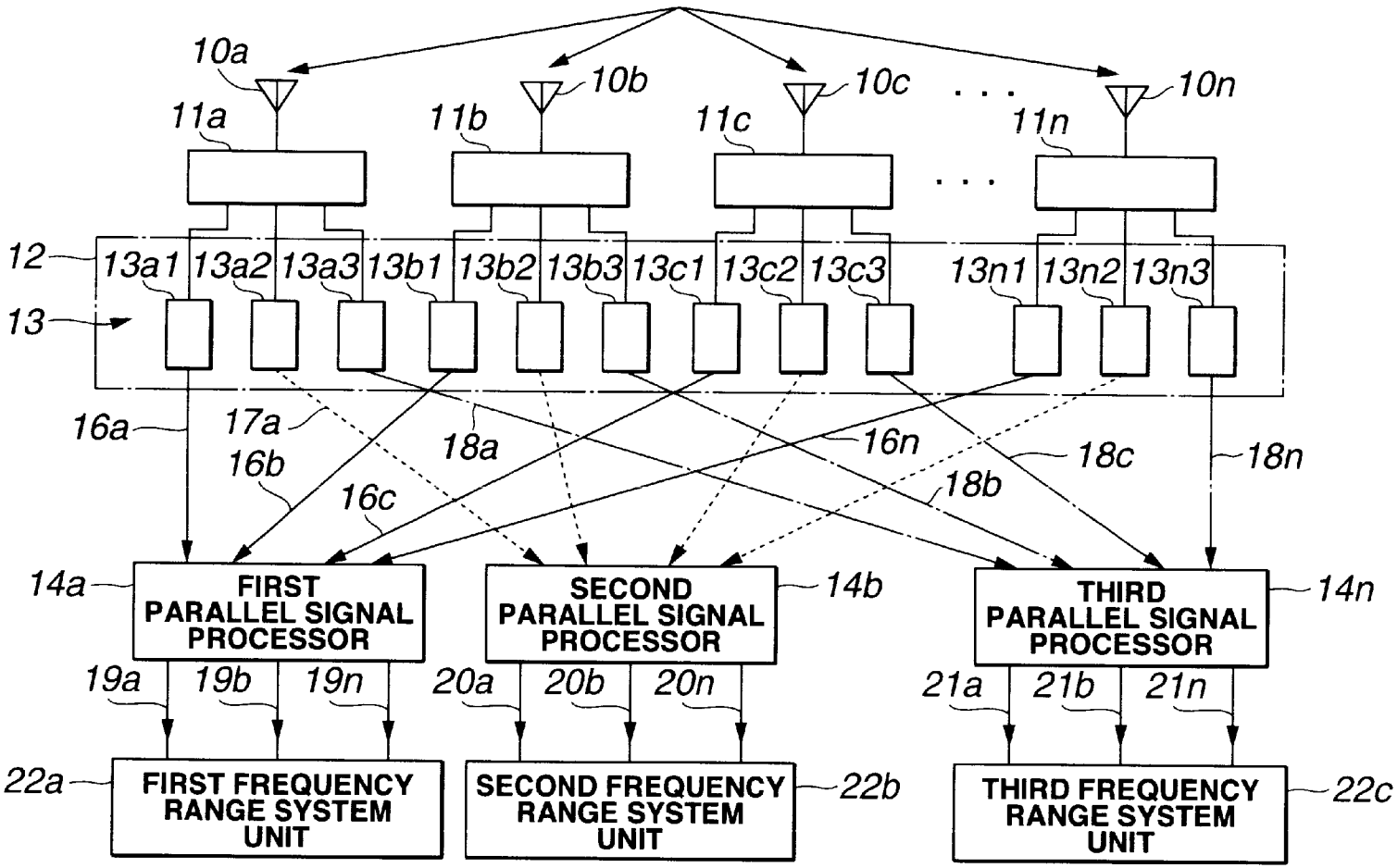
FIG. 7 is a schematic view showing a structure of the adaptive array antenna.

Referring to the drawings, preferred embodiments of the present invention will be explained in detail. A plurality of flat antennas 1, one of which is shown in FIG. 4, are arranged in adjacency to one another, as shown in FIGS. 6 and 7 to make up an antenna element. An adaptive array antenna 2 is provided in a radio apparatus 3 shown in FIG. 8, and constitutes a transmission/reception unit for receiving high frequency signals of different frequency bands transmitted from different directions and for transmitting high frequency signals of different frequency bands.

The flat antenna 1 has a basic structure similar to that of the conventional flat antenna and includes a rectangular dielectric substrate 4, a grounding conductor 5 provided on a first major surface 4*a* of the dielectric substrate 4, and a plurality of radiating conductors 6, respectively bonded to a second major surface 4*b* of the dielectric substrate 4, as shown in FIG. 4. In the flat antenna 1, a feeder line 7, made up of a coaxial cable, is passed through a feeder guide hole 8 formed in the dielectric substrate 4 so that the respective radiating conductors 6 are connected by the feeder line 7 to the grounding conductor 5. The feeder line 7 has its shell conductor and a core line connected to the grounding conductor 5 and to the radiating conductors 6, respectively.

The grounding conductor 5 is formed of metal, for example, brass, and is bonded to the first major surface 4*a* of the dielectric substrate 4, as described above. The radiating conductors 6 are bonded to the second major surface 4*b* of the dielectric substrate 4 in a state of being parallel to the grounding conductor 5. The radiating conductors 6 are formed by chips of metal, such as brass, and are each formed to substantially a square shape each side of which has a length L. Also, the radiating conductors 6 are each sized so that its side has a length of $\lambda/2$, where $\lambda$ is the wavelength of the wave transmitted/received.

Figure 5:
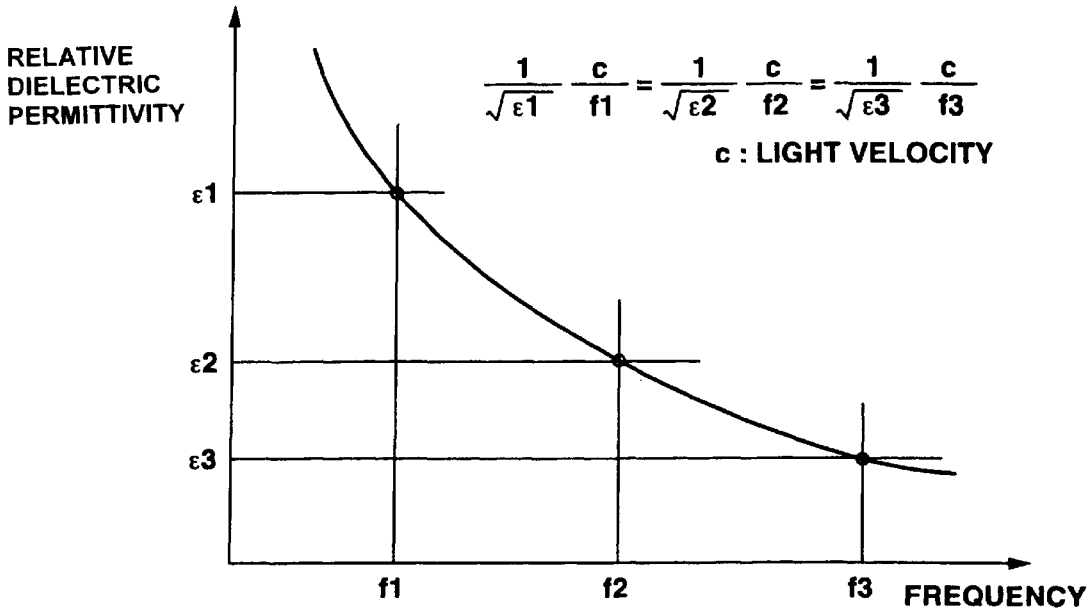
FIG. 5 is a graph showing the specific inductive capacity of a dielectric substrate used in the flat antenna of FIG. 4.

The dielectric substrate 4 is molded from a dielectric material, the specific inductive capacity of which exhibits frequency distribution characteristics. The frequency response of the dielectric substrate 4 is such that the specific inductive capacity $\epsilon$1 to $\epsilon$n with respect to the length L of the side of the radiating conductor 6 and the frequencies f1 to fn are decreased gradually with the increasing frequency, as shown in FIG. 5. The dielectric substrate 4 is so designed that, by the specific inductive capacity $\epsilon 1$ to $\epsilon n$ having characteristics such as $$2L=c/(f1\times\sqrt{\epsilon 1})=c/(f2\times\sqrt{\epsilon 2})=c/(f3\times\sqrt{\epsilon 3})\ \ldots\ =c/(fn\times\sqrt{\epsilon n\times})$$

it is possible for the dielectric substrate 4 to produce an output of the same wavelength for plural reception frequencies f1 to fn.

The dielectric substrate 4 may be molded from a hexagonal ferrite material having the composition of $BaFe_{12-2x}Me1_xMe2_xO_{19}$ or $SrFe_{12-2x}Me1_xMe2_xO_{19}$ where Me1 is a tetravalent metallic ion, such as Ti, Zr or Sn ions, and Me2 is a bivalent metallic ion, such as Co, Mn, Zn, Cu, Mg or Ni ions.

The adaptive array antenna 2, having the above-described flat antenna 1 as an antenna element, is able to receive e.g., the first frequency range f1, a second frequency range f2 and a third frequency range f3 simultaneously. The adaptive array antenna 2 includes an array of flat antennas 10 (10*a* to 10*n*) comprised of an array of plural radiating conductors 6 (6*a* to 6*n*) on the first major surface 4*a* of the dielectric substrate 4, as shown in FIG. 6.

The adaptive array antenna 2 includes a plurality of frequency distribution circuits 11 (11*a* to 11*n*) associated with the flat antennas 10, as shown in FIG. 7. Each frequency distribution circuit 11 is connected to each flat antenna 10 via feeder line 7 (7*a* to 7*n*), as shown in FIG. 6. Each frequency distribution circuit 11 distributes the high frequency signals, received by the flat antenna 10, into first to third frequency bands f1 to f3.

The adaptive array antenna 2 includes plural reception circuit units 12 (12*a* to 12*n*) in association with the frequency distribution circuits 11, as shown in FIGS. 6 and 7. Each reception circuit unit 12 has three elementary reception circuit units 13, that is a first elementary reception circuit unit 13*a*1, a second elementary reception circuit unit 13*a*2 and a third elementary reception circuit unit 13*a*3, in association with high frequency signals of first to third frequency bands f1 to f3, as shown in FIG. 7. Each reception circuit unit 12 down-converts the high frequency signals of the first to third frequency bands f1 to f3, distributed by each frequency distribution circuit 11, into baseband signals, for demodulation to bit signals.

Referring to FIG. 7, the adaptive array antenna 2 includes three parallel signal processors 14 (first to third parallel signal processors 14*a* to 14*c*) fed from the elementary reception circuit units 13 of the reception circuit unit 12 with bit signals of the first to third frequency bands f1 to f3. Each parallel signal processor 14 optimally synthesizes bit signals for each of the first to third frequency bands f1 to f3. Each parallel signal processor 14 operates as if they are directed to electrical waves in need of antenna directivity and also as if they are null in the oncoming direction of interference signals, by synthesizing the bit signals for respective frequency bands such as to cancel the information other than the necessary information and the noise. Each parallel signal processors 14 outputs the optimized bit signals to system units 15 (first to third system units 15*a* to 15*c*) associated with the first to third frequency bands f1 to f3, respectively.

Referring to FIG. 6, the adaptive array antenna 2 receives plural first high frequency signals 16 (16*a* to 16*c* indicated by solid lines in FIG. 6), transmitted from different directions by the radio communication system employing the first frequency band f1, by an array of the flat antennas 10. The adaptive array antenna 2 receives plural second high frequency signals 17 (17*a* to 17*c* indicated by dotted lines in FIG. 6), transmitted from different directions by the radio communication system employing the first frequency band f2, by an array of the flat antennas 10. Also, the adaptive array antenna 2 receives plural third high frequency signals 18 (18*a* to 18*c* indicated by chain-dotted lines in FIG. 6), transmitted from different directions by the radio communication system employing the first frequency band f3, by an array of the flat antennas 10.

The adaptive array antenna 2, in which each flat antenna 10 includes a dielectric substrate 4 having specific inductive capacity exhibiting frequency distribution characteristics, receives the high frequency signals of the same wavelength for the first to third high frequency signals. The adaptive array antenna 2 distributes the first to third high frequency signals 18, received by the respective flat antennas 10, by the frequency distribution circuits 11 to the elementary reception circuit unit 13 of the reception circuit unit 12, for each of the first to third frequency bands f1 to f3. The adaptive array antenna 2 demodulates the high frequency signals by the elementary reception circuit unit 13 into bit signals which then are output to the parallel signal processors 14.

The adaptive array antenna 2 demodulates the first high frequency signals 16*a* of the first frequency band f1, received by the flat antenna 10*a* so as to be distributed by the frequency distribution circuit 11*a*, into bit signals, in the first elementary reception circuit unit 13*a*1 of the reception circuit unit 12, to output the resulting bit signals to the first parallel signal processors 14*a*. The adaptive array antenna 2 demodulates the second high frequency signals 17*a* of the second frequency band f2, received by the flat antenna 10*a* so as to be distributed by the frequency distribution circuit 11*a*, into bit signals, in the second elementary reception circuit unit 13*a*2 of the reception circuit unit 12, to output the resulting bit signals to the second parallel signal processors 14*b*. The adaptive array antenna 2 also demodulates the third high frequency signals 18*a* of the third frequency band f3, received by the flat antenna 10*a* so as to be distributed by the frequency distribution circuit 11*a*, into bit signals, in the third elementary reception circuit unit 13*a*3 of the reception circuit unit 12, to output the resulting bit signals to the third parallel signal processors 14*c*.

The adaptive array antenna 2 demodulates the first high frequency signals 16*n* of the first frequency band f1, received by the flat antenna 10*b* so as to be distributed by the second frequency distribution circuit 11*b*, into bit signals, in the third elementary reception circuit unit 13*b*1 of the reception circuit unit 12, to output the resulting bit signals to the first parallel signal processors 14*a*. The adaptive array antenna 2 demodulates the first high frequency signals 16*n* of the first frequency band f1, received by the flat antenna 10*n* so as to be distributed by the nth frequency distribution circuit 11*n*, into bit signals, in the nth elementary reception circuit unit 13*n*1 of the reception circuit unit 12, to output the resulting bit signals to the first parallel signal processors 14*a*.

The adaptive array antenna 2 optimizes the first high frequency signals 16 of the first frequency band f1, transmitted from different directions and received by the flat antennas 10, in the first parallel signal processors 14*a*, through the aforementioned route, to output the optimized signals as reception information 19*a* to 19*n* to a first frequency band system 22*a*. The adaptive array antenna 2 optimizes the second high frequency signals 16 of the second frequency band f2, transmitted from different directions and received by the flat antennas 10, in the second parallel signal processors 14*b*, through the aforementioned route, to output the optimized signals as reception information 20*a* to 19*n* to a second frequency band system 22*b*. The adaptive array antenna 2 optimizes the third high frequency signals 18 of the third frequency band f3, transmitted from different directions and received by the flat antennas 10, in the third parallel signal processors 14*c*, through the aforementioned route, to output the optimized signals as reception information 21*a* to 21*n* to a third frequency band system 22*c*.

Thus, even if the plural high frequency signals 16 to 18 of different frequency bands f1 to f3 are sent to the adaptive array antenna 2 from different directions, the adaptive array antenna 2 is able to receive these signals without crosstalk. So, the adaptive array antenna 2 is able to receive the information not only in the same frequency band but also in different frequency bands, with compatibility, thus enabling effective frequency utilization without increasing the size of the antenna unit.

Figure 8:
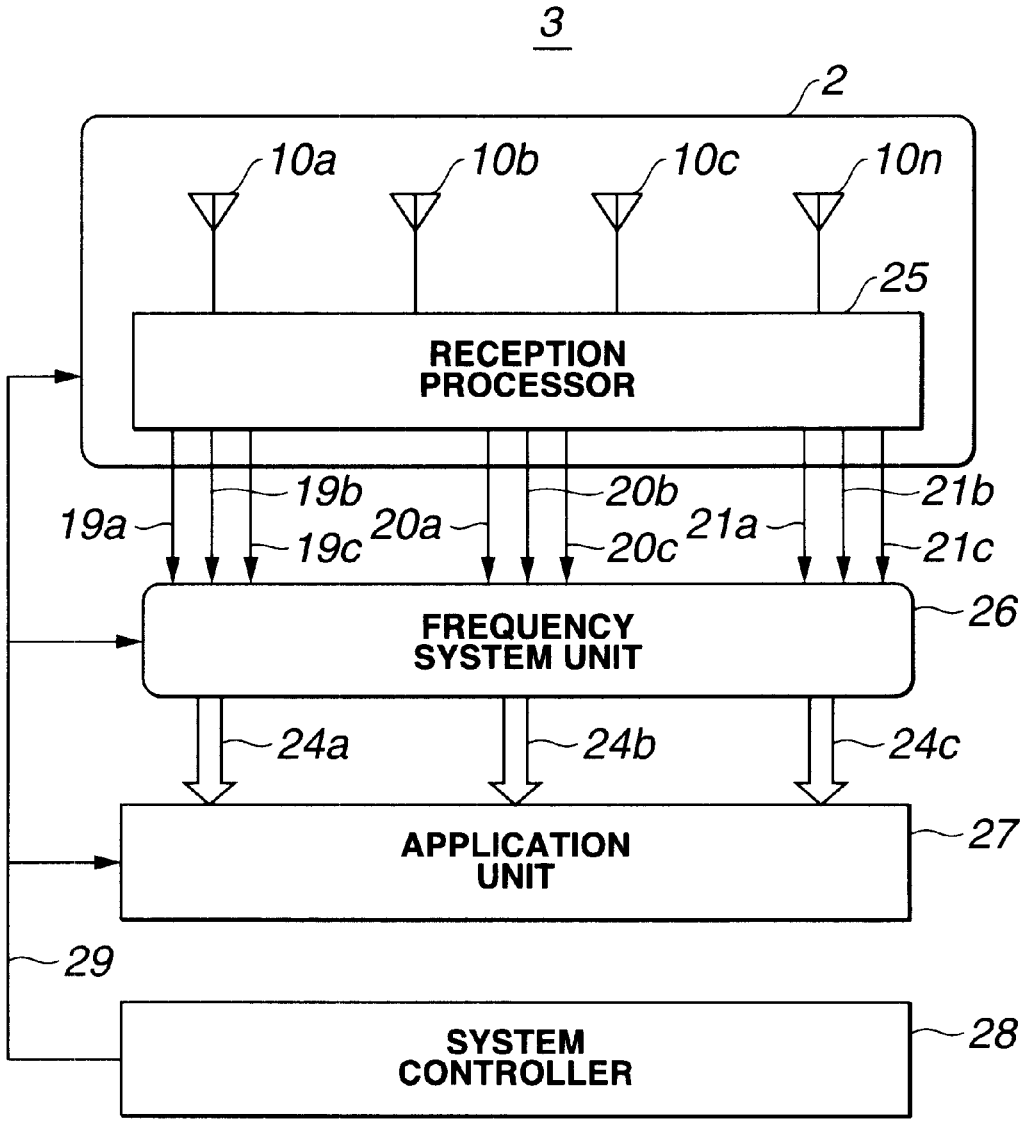
FIG. 8 is a schematic view showing a structure of a radio apparatus having the adaptive array antenna.

The radio apparatus 3, carrying the above-described adaptive array antenna 2, as shown in FIG. 8, can be used in a radio transmission system employing different frequency bands. The radio apparatus 3 receives the plural high frequency signals 16 to 18 of the different frequency bands f1 to f3, sent thereto by plural flat antennas 10 from different directions, without crosstalk, to perform optimum processing thereon in a reception processor 25. The reception processor 25 is made up of the aforementioned frequency distribution circuit 11, reception circuit unit 12 and the parallel signal processor 14.

In the radio apparatus 3, the reception information 19 to 21, optimized for each of the frequency bands f1 to f3, as described above, are output from the reception processor 25 to a frequency band system unit 26. The radio apparatus 3 performs control signal processing, in the frequency band system unit 26, of properly controlling an annexed application unit 27, such as display unit or memory, to output control signals 24*a* to 24*c* associated with the frequency bands f1 to f3, respectively. The radio apparatus 3 performs pre-set processing in each part of the application unit 27, based on the control signals 24*a* to 24*c*.

In the radio apparatus 3, the adaptive array antenna 2, frequency band system unit 26 or the application unit 27 is controlled by a control signal 29 output by s system controller 28. The system controller 28 controls the accommodation to the frequency bands f1 to f3 or to the communication system, signal processing or application control by a software program to output a control signal 29. In other words, the entire operation of the radio apparatus 3 is controlled by the software program.

In the above-described embodiment, the operation of receiving the first to third high frequency signals 16 to 18 based on the first to third frequency bands f1 to f3 has been explained. It is however to be noted that the adaptive array antenna of the present invention can also be connected in use to a transmission section. Although the dielectric substrate 4 has its dielectric substrate 4 formed of hexagonal ferrite to impart frequency distribution properties, the dielectric substrate 4 may, of course, be formed of any other suitable materials, Although the radiating conductors 6 are formed by square-shaped batch devices, formed by rectangular chips, the present invention is, of course, not limited to these devices. The radiating conductors 6 may also be formed by arranging linear elements in a lattice shape or by etching a metal foil bonded to the surface of the dielectric substrate 4 e.g., by etching.

What is claimed is:

1. An antenna element comprising:

a substrate formed of a dielectric material having a relative dielectric permittivity exhibiting frequency dependent properties of negative slope;

a grounding conductor formed on a surface of said substrate;

a plurality of radiating conductors formed on an other surface of said substrate; and a plurality of feeder lines passing through said substrate, each said feeder line including a shell conductor connected to said grounding conductor and a core line connected to one of said radiating conductors.

2. The antenna element according to claim 1 wherein each of said radiating conductors is of a square shape with each side thereof L being such that $L=\lambda/2$, where L is the length of each side of the square and $\lambda$ is the wavelength of a reception or a transmission signal.

3. The antenna element according to claim 2 wherein said radiating conductors are arranged in an array.

4. An adaptive antenna apparatus comprising:

a substrate formed of a dielectric material having a relative dielectric permittivity exhibiting frequency dependent properties of negative slope;

a grounding conductor formed on a surface of said substrate;

a plurality of radiating conductors formed on an other surface of said substrate;

a plurality of feeder lines passing through said substrate, each said feeder line including a shell conductor connected to said grounding conductor and a core line connected to one of said radiating conductors;

a frequency band distributing circuit fed with a reception signal of a plurality of frequency bands from said radiating conductors over said feeder line for outputting signals of said frequency bands in said reception signal in separate frequency bands;

a plurality of demodulation circuits for demodulating the signals of the respective frequency bands from said frequency band distributing circuit; and a signal synthesis circuit for synthesizing demodulated signals from said demodulating circuits according to said separate frequency bands.

5. The adaptive antenna apparatus according to claim 4 wherein each of said radiating conductors is of a square shape with each side thereof L being such that $L=\lambda/2$, where L is the length of each side of the square and $\lambda$ is the wavelength of a reception or a transmission signal.

6. The adaptive antenna device according to claim 5 wherein said radiating conductors are arranged in an array.

7. A radio communication apparatus capable of communication in a plurality of communication systems, comprising:

a substrate formed of a dielectric material having a relative dielectric permittivity exhibiting frequency dependent properties of negative slope;

a grounding conductor formed on a surface of said substrate;

a plurality of radiating conductors formed on an other surface of said substrate;

a plurality of feeder lines passing through said substrate, each said feeder line including a shell conductor connected to said grounding conductor and a core line connected to one of said radiating conductors;

a frequency band distributing circuit fed with a reception signal or a plurality of frequency bands from said radiating conductors over said feeder line for outputting signals of said frequency bands in said reception signal in separate frequency bands;

a plurality of demodulation circuits for demodulating the signals of the respective frequency bands from said frequency band distributing circuit;

a signal synthesis circuit for synthesizing demodulated signals from said demodulating circuits according to said separate frequency bands; and a signal processing circuit fed with signals from said signal synthesis circuit synthesized for said respective frequencies, said signal processing circuit accommodating said plural communication systems.

8. The radio communication apparatus according to claim 7 wherein each of said radiating conductors is of a square shape with each side thereof L being such that $L=\lambda/2$, where L is the length of each side of the square and $\lambda$ is the wavelength of a reception or a transmission signal.

9. The radio communication apparatus according to claim 8 wherein said radiating conductors are arranged in an array.

* * * * *